US006145515A

United States Patent [19]

Wu

[11] Patent Number: 6,145,515

[45] Date of Patent: Nov. 14, 2000

[54] MULTI-COLOR LIPSTICK CASE

[75] Inventor: Shang-Wu Wu, Tainan, Taiwan

[73] Assignee: Hong-Yi Cosmetics Co., Ltd., Tainan, Taiwan

[21] Appl. No.: 09/433,646

[22] Filed: Nov. 3, 1999

[51] Int. Cl.[7] ..... A45D 33/24; A45D 33/22; B65D 69/00; B65D 6/28

[52] U.S. Cl. ..... 132/295; 132/294; 220/4.27; 206/581

[58] Field of Search ..... 132/295, 297, 132/294; 206/581, 503, 509; 220/4.27, 4.26, 4.33, 4.34

[56] References Cited

U.S. PATENT DOCUMENTS

| | | | |
|---|---|---|---|
| 1,385,484 | 7/1921 | Case | 206/581 |
| 1,507,573 | 9/1924 | Bieshuns | 132/295 |
| 2,663,608 | 12/1953 | Schauer | 206/581 |
| 3,392,868 | 7/1968 | Pfrommer | 132/295 |
| 3,441,033 | 4/1969 | Flax | 132/295 |
| 3,498,471 | 3/1970 | Dirkx | 206/581 |
| 4,815,483 | 3/1989 | Dugrenier et al. | 132/295 |
| 5,246,020 | 9/1993 | Wu | 132/295 |
| 5,671,856 | 9/1997 | Lisch | 220/4.27 |
| 5,740,906 | 4/1998 | Lai | 206/214 |

*Primary Examiner*—Gene Mancene
*Assistant Examiner*—Robyn Kieu Doan
*Attorney, Agent, or Firm*—Pro-Techtor International Services

[57] ABSTRACT

A multi-color lipstick case includes a bottom base, a plurality of inner cases piled up vertically straight on the bottom base and a cylindrical cover. The inner cases have a through hole eccentrically located at one side to pivotally connected to a postion shaft to permit each inner case swing out to expose a hollow room filled with a kind of lipstick for use. The through holes of the inner cases and the position shaft have a position device to engage with each other so that any inner case can be positioned at a swung out position without moving at random. When all the inner cases are swung in to pile up vertically straight, the cylindrical cover covers all the inner cases on the bottom base. Thus the multi-color lipstick case have a small size, convenient to be carried out, with many different color lipsticks usable.

7 Claims, 7 Drawing Sheets

MULTI-COLOR LIPSTICK CASE

BACKGROUND OF THE INVENTION

This invention relates to a multi-color lipstick case, particularly to one provided with many different color lipsticks for use when carried out, having a small dimensions easy to carry.

There are generally two kinds of conventional lipstick cases.

A first kind of conventional lipstick case has a rotatable bottom base and a lipstick bar contained in a housing, and the lipstick bar is lifted up by rotating the bottom base for coating the lipstick on a lip. This conventional lipstick base is small, easy to carry, but it has only one color lipstick. An usually only one lipstick is not enough, with several different color lipsticks needed to be prepared to be carried out for use. Then it would be a little inconvenient. Besides, one lipstick bar may last a substantial period of time, and pass the valid data before used up to be discarded.

There is "A Multi-color Connected Lipstick Case" disclosed in a Taiwan Publication No. 2245583 (its photo copy is enclosed), wherein many color lipsticks are contained, but it has a large dimensions, inconvenient to carry out.

A second kind of conventional lipsticks is a disc lipstick case, which has almost the same shape as a powder pack, with many of small sections filled with different color lipsticks for use. However, this disc lipstick case is also comparatively large, not so easy to carry as conventional lipstick cases.

SUMMARY OF THE INVENTION

This invention has been devised to offer a multi-color lipstick case not only having many different color lipsticks for use, but a small dimensions to be easily carried out.

The feature of the invention is a plurality of inner cases pivotally connected and eccentrically at a side with a postion shaft to pile up vertically straight on a bottom base, and a cylindrical cover covers around all the inner cases when not in use. Any of the inner cases may be swung out to let its inner hollow room filled with a color lipstick to expose for use. All the inner cases have different color lipsticks.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
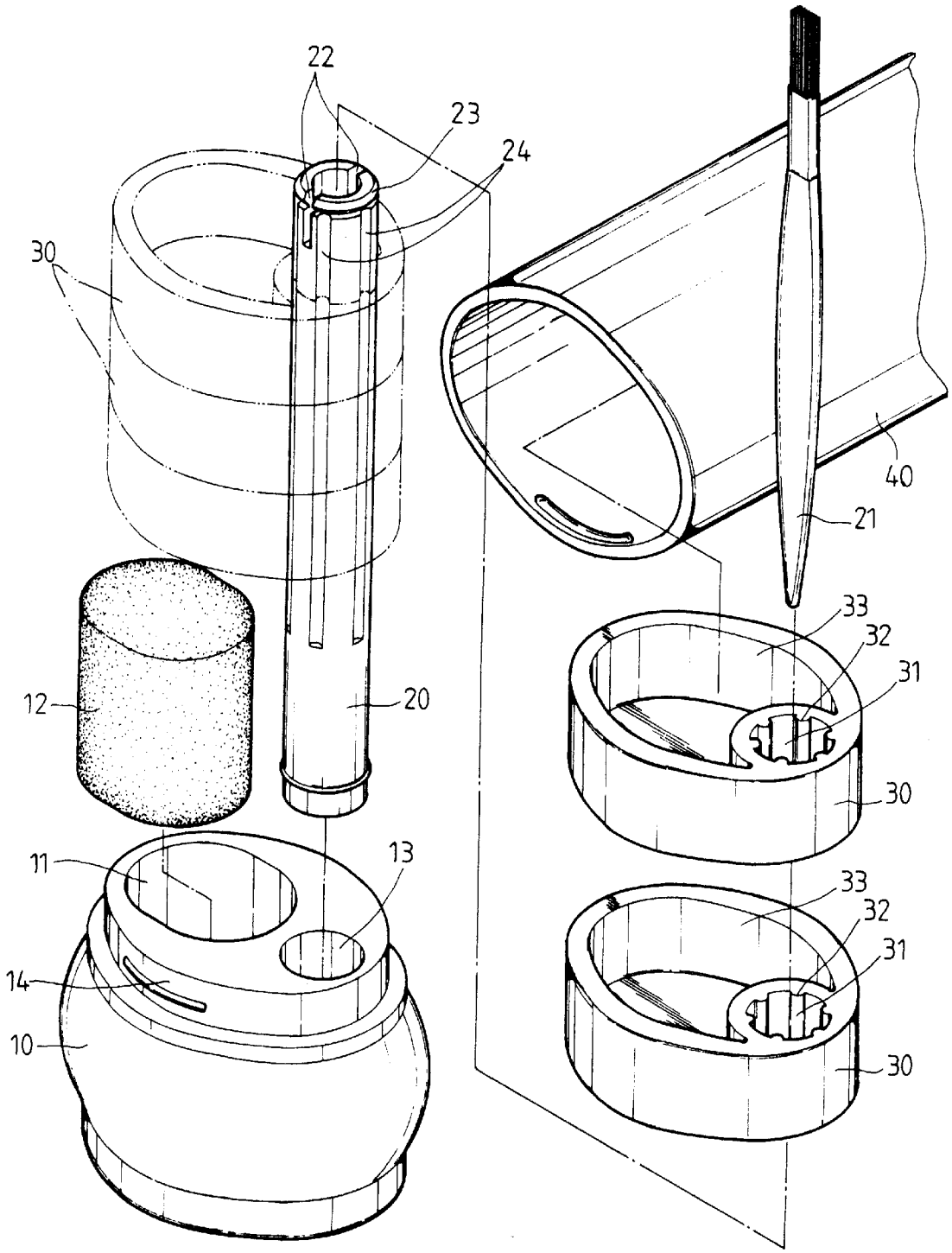
FIG. 1 is an exploded perspective view of a first embodiment of a multi-color lipstick case in the present invention.
Figure 2:
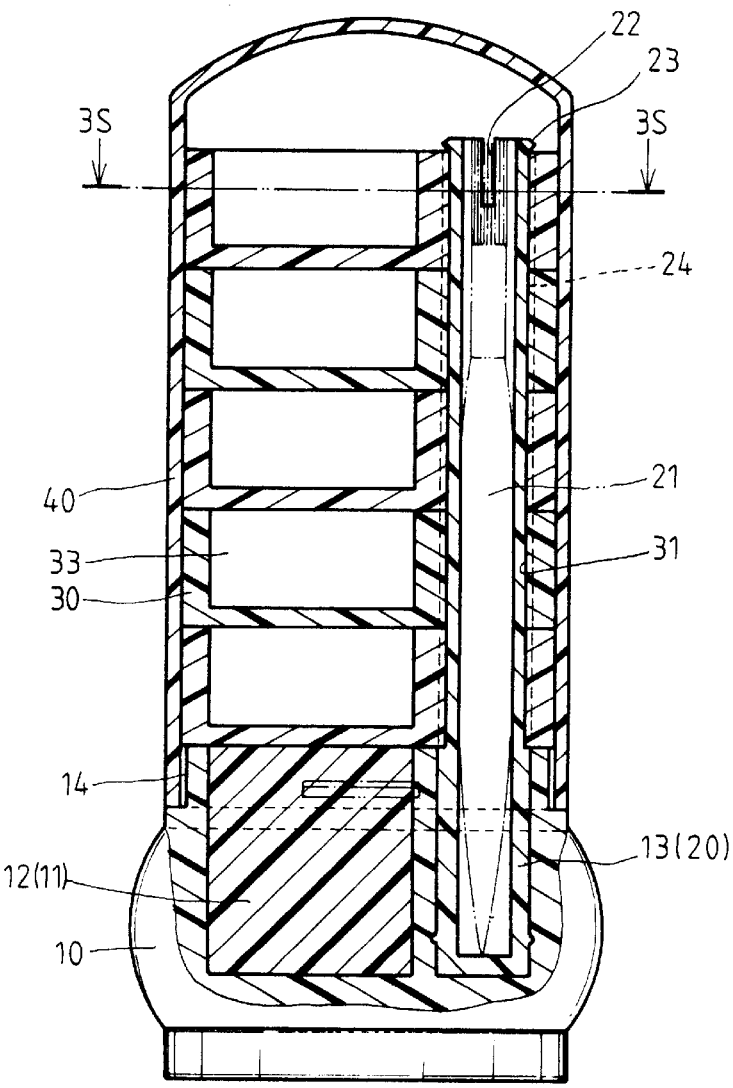
FIG. 2 is a cross-sectional view of the first embodiment of a multi-color lipstick case in the present invention.

A first embodiment of a multi-color lipstick case in the present invention, as shown in FIGS. 1 and 2, includes a bottom case 10, a position shaft 20, a plurality of inner cases 30, and a cylindrical cover 40 as main components combined together.

The bottom base 10 has a vertical room 11, for putting a wipe cotton 12 therein, a vertical position hole 13 beside the vertical room 11, and a contact circumferential wall 14 in an upper portion a little recessed than the outer circumference of the lower portion.

The position shaft 20 is an elongate hollow tube, a lip brush 21 contained therein, having its end fitted tightly in the position hole 13 of the bottom base 10, two opposite slots 22 formed in an upper end and possible to shrink inward if pressed inward, and a convex-edge lip 23 formed in the upper end, and a plurality of vertical straight grooves 24 spaced apart in an outer circumferential surface.

Figure 3:
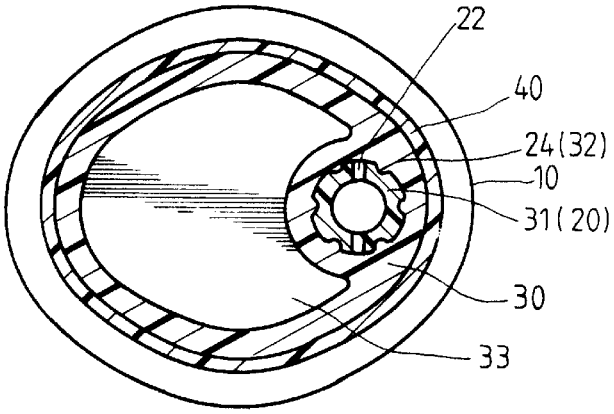
FIG. 3 is a cross-sectional view of line 3S—3S in FIG. 3.

The plurality of inner cases 30 are oval and having respectively a through hole 31 eccentrically located at one side and fitting around the position shaft 20, and the through hole having a plurality of vertical projecting ridge 32 formed in an inner surface to engage the vertical grooves 24 of the shaft 20. Then the inner cases 30 may be combined with the position shaft 20 one on the other, piling up one another, and possible to be swung eccentrically outward with the position shaft 20 as a pivot. In addition, each inner case 30 can be kept positioned with the ridges 32 engaging the straight grooves 24 after swinging out in different angles as the ridges 32 and the straight grooves 24 functioning as positioning means, as shown in FIG. 3. Each inner case 30 has a hollow room 33 defined by the circumferential wall and the wall of the through hole 31 for storing a lipstick therein. The uppermost inner case 30 is kept under the lip 23 of the position shaft 20 from slipping out of the shaft 20 as shown in FIG. 2.

The cylindrical cover 40 closes the straight outer circumferential surfaces of all inner cases 30, with the lower end fitting around the contact wall 14 of the bottom base 10.

Figure 4:
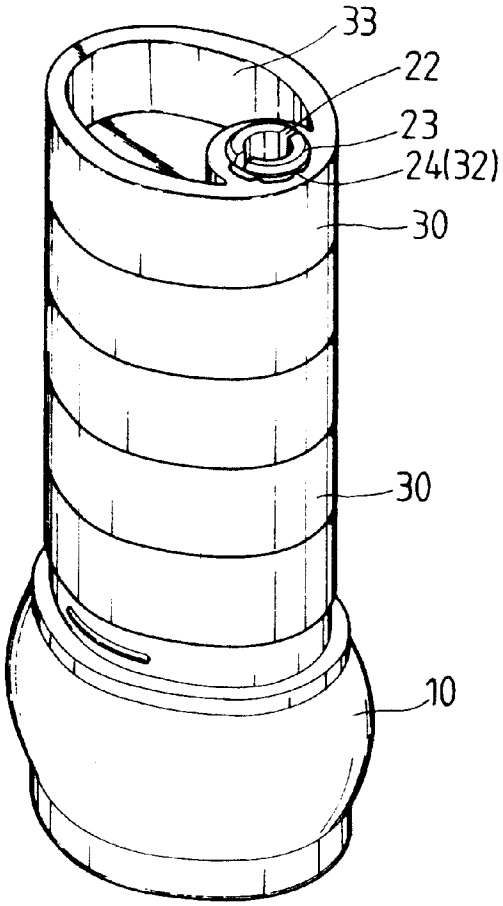
FIG. 4 is a perspective view of the first embodiment of a multi-color lipstick case with a cylindrical cover removed in the present invention.
Figure 5:
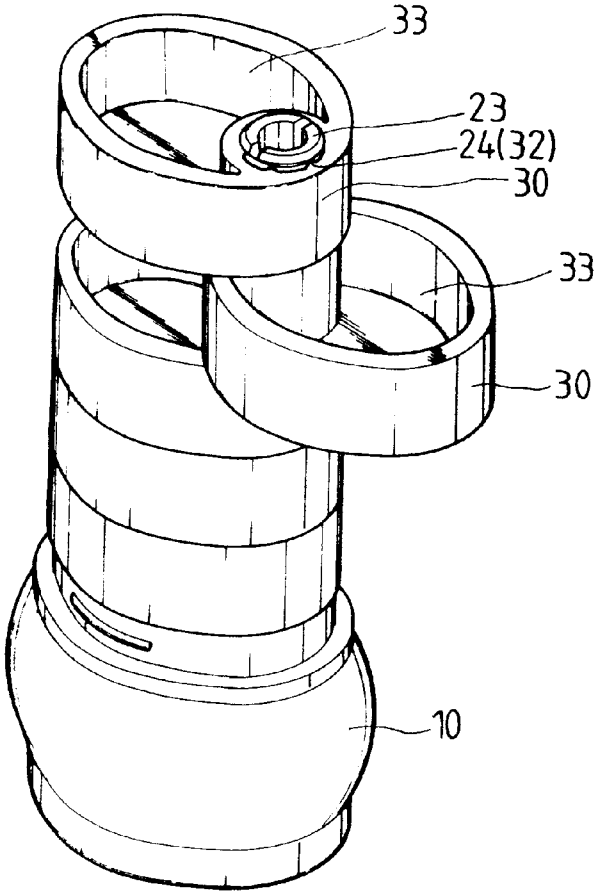
FIG. 5 is a perspective view of the first embodiment of multi-color lipstick being used in the present invention.

Next, as shown in FIG. 2, after the multi-color lipstick case is assembled together, all the hollow rooms 33 of all the inner cases 30 are filled with different color lipsticks. In using, the cylindrical cover 40 is firstly taken off as shown in FIG. 4, and the lip brush 21 is pulled out of the position shaft 20. In using, 1. All the inner cases 30 are swung out for an angle, letting the wipe cotton 12 expose out so that the lip brush 21 can brush the wipe cotton 12 to clean itself.

Figure 7:
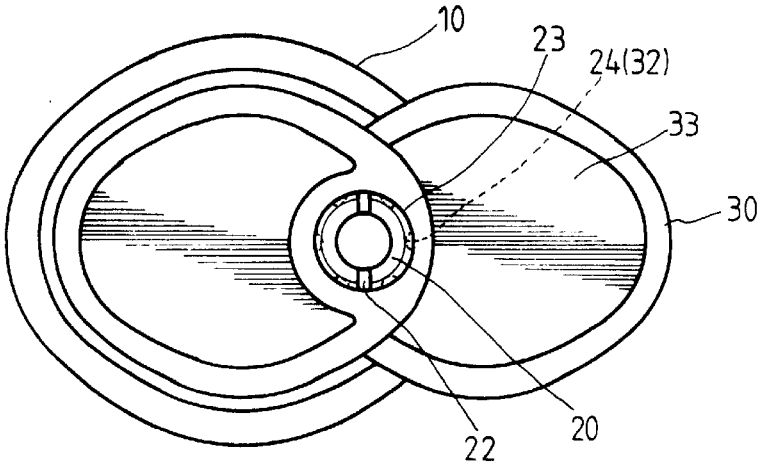
FIG. 7 is an upper view of FIG. 6.
Figure 6:
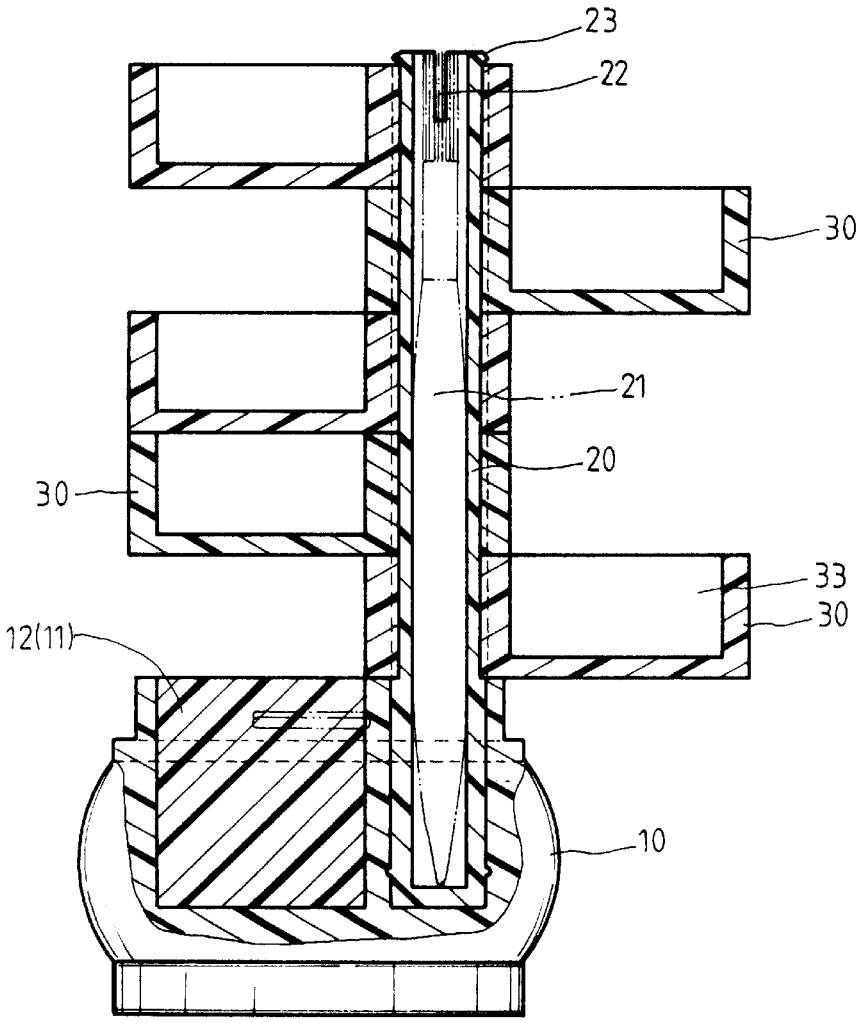
FIG. 6 is a cross-sectional view of the first embodiment of multi-color lipstick case being used in the present invention.
Figure 8:
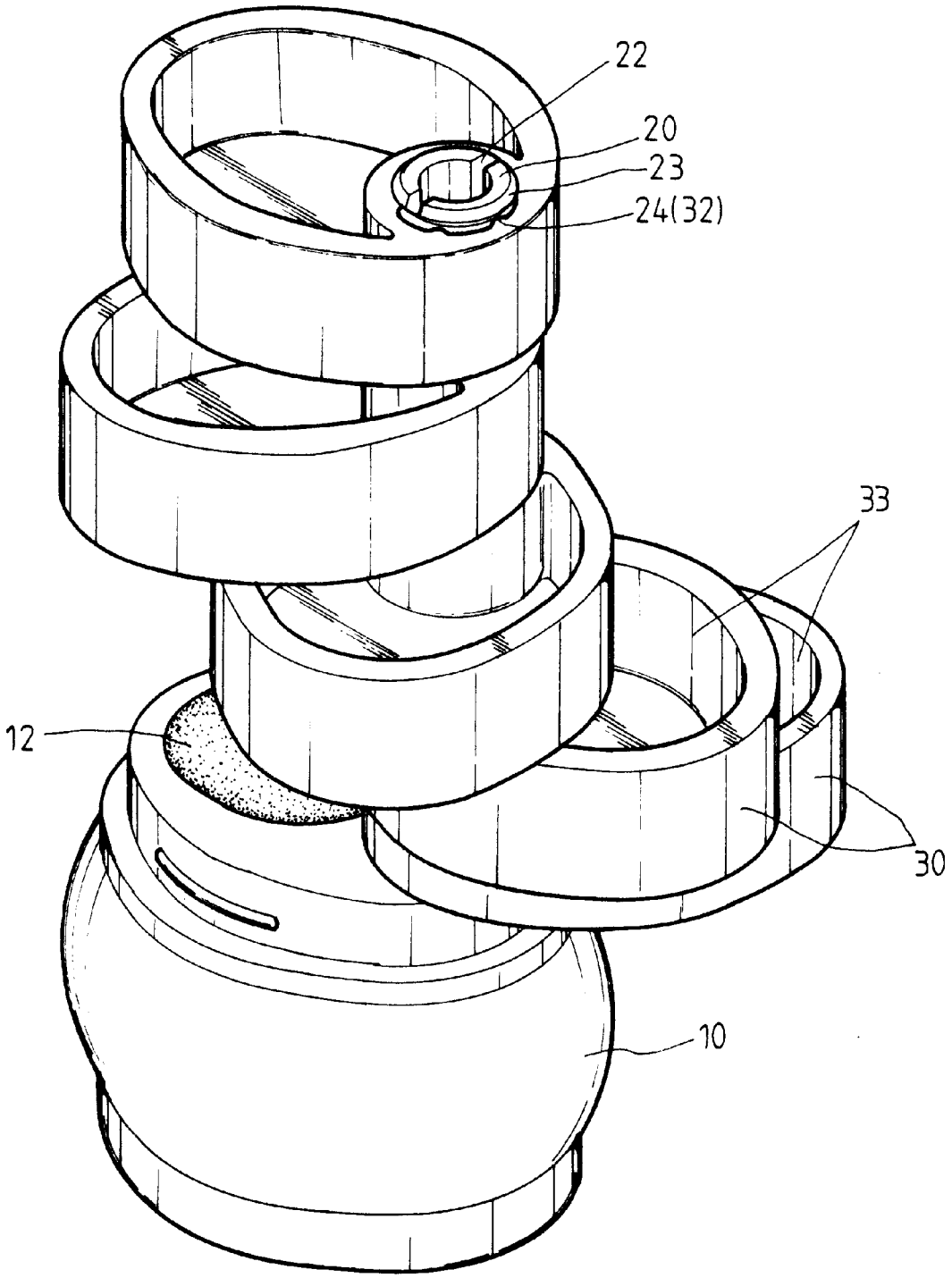
FIG. 8 is a perspective view of the first embodiment of a multi-color lipstick case being used in another way in the present invention.

2. Then any of the inner cases 30 may be swung out further to expose as shown in FIGS. 5–8 for the lip brush 21 to daub the lipstick to coat on the lip. If the inner case 30 is swung for a certain angle, the ridges 31 always engage the straight grooves 24 of the shaft 20, keeping the inner cases 30 in position, without moving at random, as shown in FIG. 7.

3. After the lip is coated with needed lipstick, all the inner cases 30 can be swung back to the original piled up position, as shown in FIG. 4, and then the cylindrical cover 40 may be closed around the inner cases 30 and on the bottom base 10.

4. In case that any of the inner cases 30 has its lipstick used up, or is wanted to be altered to other lipstick, the inner cases 30 may be pushed up to overpass the lip 23 of the position shaft 20 to separate from the shaft 20, and new inner cases may be fitted around the shaft through the lip 23 down.

Figure 9:
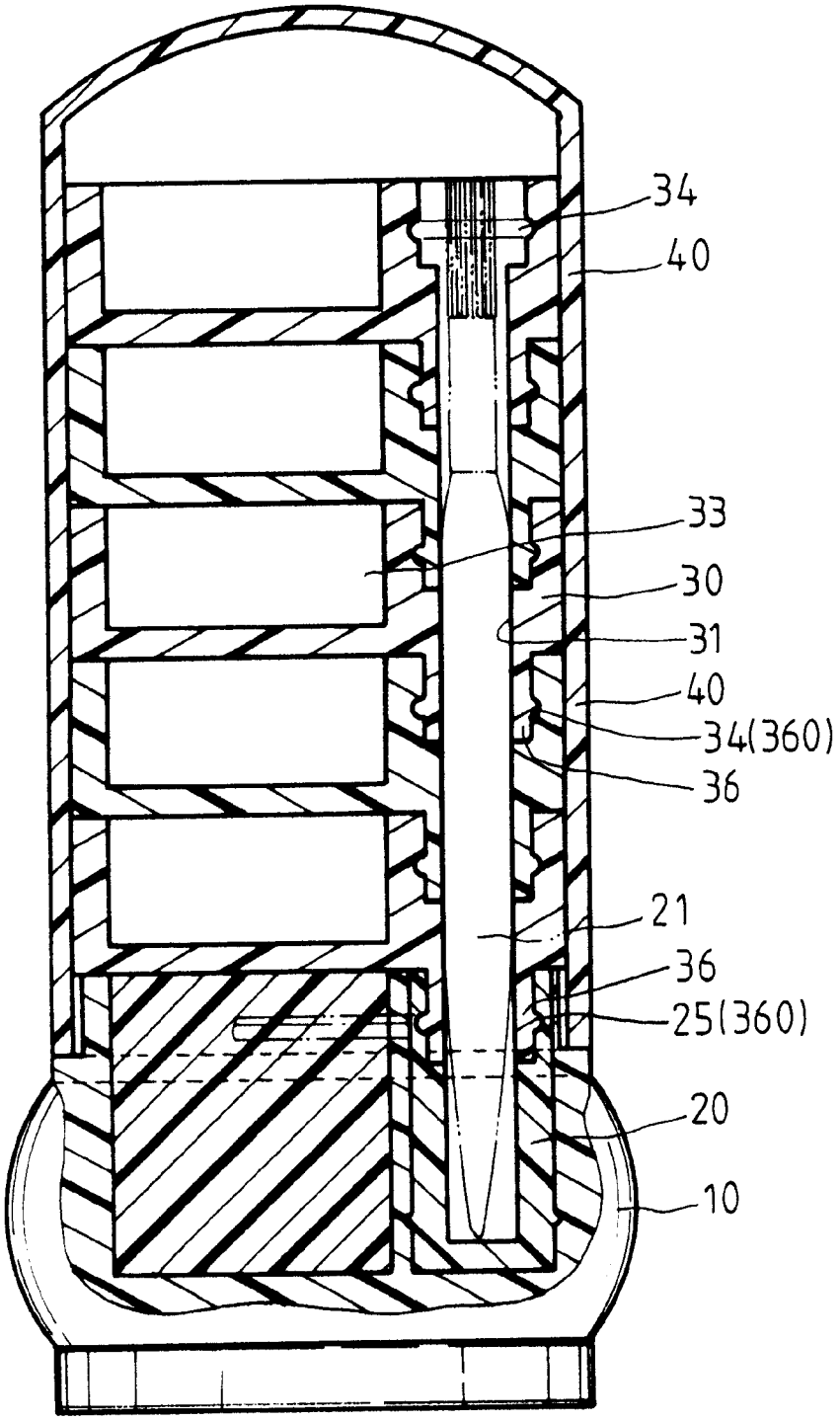
FIG. 9 is a cross-sectional view of a second embodiment of a multi-color lipstick case in the present invention.
Figure 11:
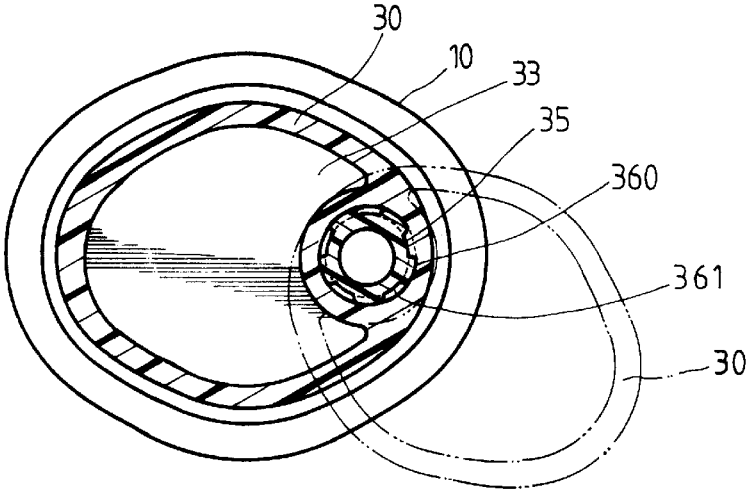
Figure 10:
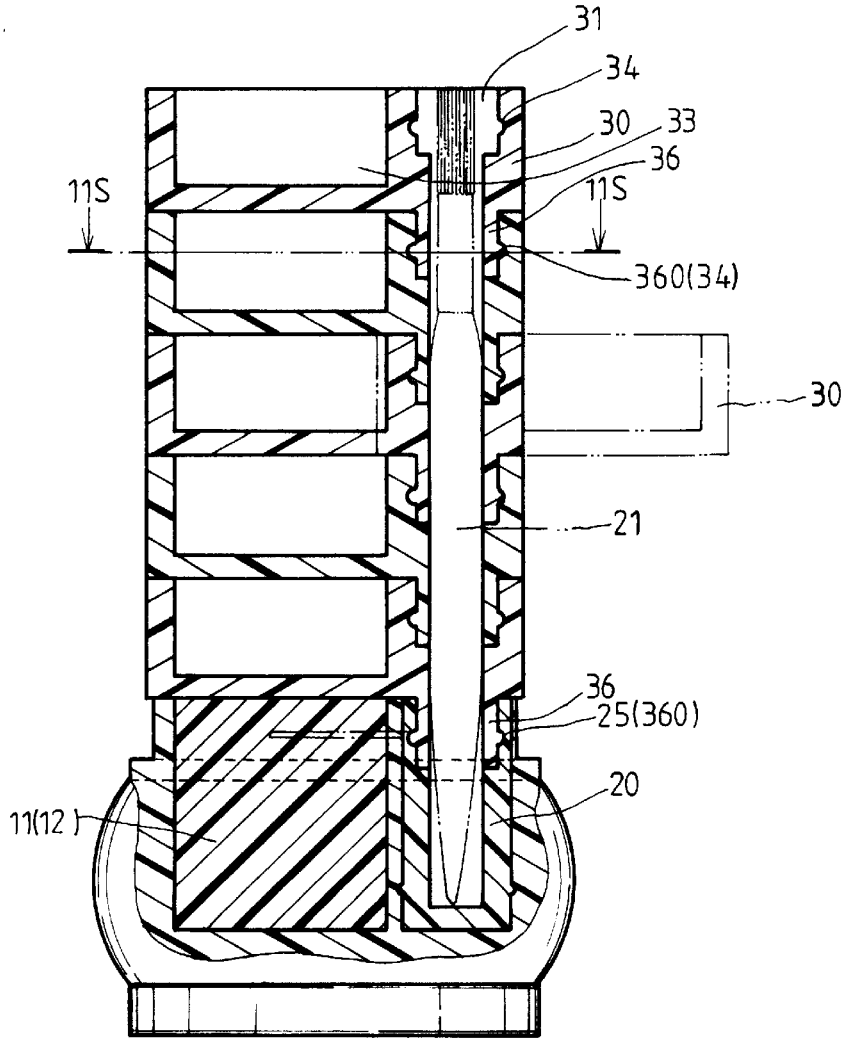
FIG. 10 is a cross-sectional view of the second embodiment being used with the cylinder cover removed in the present invention; and, FIG. 11 is a cross-sectional view of line 11S—11S in FIG. 10.

Next, a second embodiment of a multi-color lipstick case in the invention is shown in FIGS. 9, 10, and 11, includes the same structure, except that the throug hole 31 of each inner case 30 has an annular recess 34, recess 34, and plural, preferably five, projecting blocks 35 formed spaced apart in the annular recess 34 recess 34 as shown in FIG. 11, and a tubular member 36 extending down from the lower end of the through hole 31, plural short ridges 360 formed spaced apart on an outer surface of the tubular member 36, and a position recess 361 formed between every two short ridges 360 as shown in FIG. 11. And the position shaft 20 only has the height to reach the tubular member 36 of the lowest inner case 30, having an annular groove 25 for the tubular member 36 of the lowest inner case 30 to engage to secure the position shaft 20 in place.

In piling up the inner cases 30, an upper inner case 30 has the short ridges 360 of its tubular member 36 engaging the annular groove 34 of a lower inner case 30 to secure the two inner case together, with the projecting blocks 35 fitting in the recesses 361 between every two short ridges 360 to secure the two inner cases 30 stably one on the other. In addition, the annular groove 34 and the short ridges 360 are all annular, the inner case 30 can eccentrically swing as shown in FIGS. 10 and 11. Further, the projecting blocks 35 engage the the position recesses 361, positioning as the ecceentric rotation of the inner case 30, (in other words, the projecting blocks 35 and the position recesses 361 constitutes positioning means), keeping the inner cases 30 from moving at random, as shown in FIG. 11. The through holes 31 of all the inner cases 30 still form straight through, so the lip brush 21 can fit therein and in the hole of the shaft 20, as shown in FIG. 10.

As can be understood from the aforesaid description, the invention has the following advantages.

1. Having a small size, convenient to be carried out, as the conventional lipstick cases.

2. Having the same advantage of a disc lipstick case of many colored lipsticks.

3. Possible to replace any inner case with new inner cases to have all the inner cases with lipsticks wanted.

While the preferred embodiments of the invention have been described above, it will be recognized and understood that various modifications may be made therein and the appended claims are intended to cover all such modifications which may fall within the spirit and scope of the invention.

ENCLOSED: A photo copy of a Taiwan Publication No. 224583.

I claim:

1. A multi-color lipstick case comprising:

a bottom base, a plurality of inner cases positioned on said bottom base, each inner case has a hollow interior space to receive lip makeup therein, and a cylindrical cover covering all of said inner cases; wherein said inner cases are stacked vertically, each said inner case having a through hole eccentrically located therein, said through holes receiving a position device that enables each of said inner cases to pivot outward about said position device so as to expose said interior spaces of said inner cases, and wherein said position device includes locking means to secure said inner cases in at least one fixed open position so that said inner cases do not swing randomly when opened.

2. The multi-color lipstick case as claimed in claim 1, wherein:

said position device comprises a position shaft extending from an upper surface of said bottom base through said through holes of each said inner case, said position shaft having a plurality of vertical grooves spaced equidistantly on its outer surface; and said through holes of said inner cases have a plurality of projecting ridges spaced equidistantly on an inner surface of said through holes of said inner cases to receive said vertical grooves of said position shaft; such that engagement of said projecting ridges of said inner cases with said vertical grooves of said position shaft permit said inner cases to be secured in position at multiple angles relative to said position shaft.

3. The multi-color lipstick case as claimed in claim 1, wherein:

said through holes each include an annular groove and a plurality of projecting blocks spaced in said annular groove; each of said inner cases includes a tubular member extending downward from a lower surface of each said inner case, said tubular member having a plurality of ridges spaced on an outer surface, thereby forming a position recess between pairs of adjoining ridges; such that said inner cases are pivotally connected to adjoining cases by engagement of said tubular member of an upper inner case being received in said through hole of a lower inner case so that said ridges of said lower inner case are received in said annular groove of said upper inner case, with said projecting blocks of said upper inner case engaging said position recesses of said lower inner case; a mounting shaft extends upward from an upper surface of said bottom base, an upper end of said mounting shaft being received in a lowermost inner case.

4. The multi-color lipstick case as claimed in claim 1, wherein:

said position shaft is hollow so as to be adapted to contain a lip brush therein.

5. The multi-color lipstick case as claimed in claim 4, wherein:

said position shaft has a plurality of vertical slots and a convex-edge lip formed in an upper end of said position shaft to permit said inner cases to be separated from so as to allow replacement of said inner cases.

6. The multi-color lipstick case as claimed in claim 3, wherein:

said position shaft is hollow so as to be adapted to contain a lip brush therein.

7. The multi-color lipstick case as claimed in claim 1, wherein:

said bottom base has a cavity in an upper surface thereof, said cavity is adapted to contain a cotton wipe.

* * * * *